US009803422B2

(12) United States Patent
Johnson

(10) Patent No.: US 9,803,422 B2
(45) Date of Patent: Oct. 31, 2017

(54) LADDER SUPPORT AND MOVEMENT ASSEMBLY

(71) Applicant: Robert L. Johnson, Harleysville, PA (US)

(72) Inventor: Robert L. Johnson, Harleysville, PA (US)

( * ) Notice: Subject to any disclaimer, the term of this patent is extended or adjusted under 35 U.S.C. 154(b) by 0 days.

(21) Appl. No.: 14/965,155

(22) Filed: Dec. 10, 2015

(65) Prior Publication Data

US 2017/0167196 A1 Jun. 15, 2017

(51) Int. Cl.

| | |
|---|---|
| ***E06C 1/397*** | (2006.01) |
| ***E06C 1/12*** | (2006.01) |
| ***E06C 7/42*** | (2006.01) |
| ***E06C 1/22*** | (2006.01) |
| ***E06C 1/16*** | (2006.01) |

(52) U.S. Cl.

CPC ..... *E06C 1/397* (2013.01); *E06C 1/12* (2013.01); *E06C 1/16* (2013.01); *E06C 1/22* (2013.01); *E06C 7/423* (2013.01)

(58) Field of Classification Search

CPC . E06C 1/397; E06C 7/423; E06C 5/24; E06C 5/02; E06C 1/12; E06C 1/16; E06C 1/22

See application file for complete search history.

(56) References Cited

U.S. PATENT DOCUMENTS

| | | | | |
|---|---|---|---|---|
| 237,616 A | | 2/1881 | Sherwood | |
| 275,905 A | * | 4/1883 | Hamlin | E06C 1/397 182/17 |
| 405,969 A | | 6/1889 | Odle | |
| 445,487 A | * | 1/1891 | Arnold | E06C 1/397 182/16 |
| 589,326 A | * | 8/1897 | Alexander | E06C 1/22 182/168 |

(Continued)

FOREIGN PATENT DOCUMENTS

| | | | | |
|---|---|---|---|---|
| DE | 840027 C | * | 5/1952 | E06C 1/10 |
| GB | 243908 A | | 12/1925 | |
| GB | 667399 A | * | 2/1952 | E06C 1/10 |

OTHER PUBLICATIONS

International Search Report and Written Opinion dated Mar. 15, 2017 for International Patent Application No. PCT/US2016/063979 (9 pages).

*Primary Examiner* — Katherine Mitchell
*Assistant Examiner* — Marcus Menezes
(74) *Attorney, Agent, or Firm* — Fox Rothschild LLP

(57) ABSTRACT

A ladder support assembly including a base frame having first and second ends and a pair of pivot supports extending from the base frame which support a rod configured to pivotally support a ladder relative to the base frame. A pivot frame is pivotally mounted to the base frame and is biased away from the base frame. A bracket assembly is pivotally mounted to the pivot frame and includes a pair of bracket plates. Each bracket plate has an inner flange and outer flange with a ladder rail receiving area between the inner and outer flanges. The ladder receiving area is configured such that the bracket plate is slidable relative to a respective ladder rail received therein. A crank assembly includes a spool rotatably supported on the base frame and a cord wound about the spool with a free end of the cord connected relative to the pivot frame.

17 Claims, 10 Drawing Sheets

(56) References Cited

U.S. PATENT DOCUMENTS

| | | | | | |
|---|---|---|---|---|---|
| 986,953 | A | * | 3/1911 | Soule | E04G 1/24 182/16 |
| 1,021,629 | A | | 3/1912 | Reichardt | |
| 2,186,119 | A | * | 1/1940 | Moen | E06C 1/22 182/127 |
| 2,233,333 | A | * | 2/1941 | Wick | A47B 3/00 182/16 |
| 2,600,807 | A | | 6/1952 | Rieser | |
| 3,612,218 | A | * | 10/1971 | Blair | E06C 1/397 182/127 |
| 3,882,964 | A | | 5/1975 | Schellenberg | |
| 3,891,062 | A | | 6/1975 | Geneste | |
| 4,632,220 | A | | 12/1986 | Murrell | |
| 4,690,248 | A | | 9/1987 | Killeen | |
| 4,793,437 | A | | 12/1988 | Hanthorn | |
| 5,033,584 | A | | 7/1991 | Battle | |
| 5,791,434 | A | | 8/1998 | Swiderski | |
| 5,857,544 | A | | 1/1999 | Del Sole | |
| 6,053,284 | A | * | 4/2000 | Fountain | E06C 7/423 182/180.2 |
| 6,640,928 | B1 | | 11/2003 | Ridley, Jr. | |
| 6,820,723 | B2 | | 11/2004 | Huber | |
| 9,085,936 | B2 | * | 7/2015 | Mosier | E06C 5/04 |
| 9,109,394 | B2 | * | 8/2015 | Hernandez | E06C 5/02 |
| 2006/0169536 | A1 | * | 8/2006 | Davis | E06C 5/04 182/127 |
| 2015/0191975 | A1 | | 7/2015 | Cox | |

* cited by examiner

LADDER SUPPORT AND MOVEMENT ASSEMBLY

FIELD OF THE INVENTION

This invention relates to a ladder support and movement assembly. More particularly, this invention relates to an assembly which facilitates easy movement of a heavy ladder and then provides a stable base for the ladder once in use.

BACKGROUND OF THE INVENTION

Extension ladders are generally comprised of an upper and lower section at least and possibly more. Each section is comprised of a pair generally parallel rails with the usual rungs for stepping on extending between the rails. The upper and lower ladder sections are slidably mounted with respect to each other. The upper ladder section is extendible with respect to the lower ladder section. The upper section can be extended to varying lengths to provide additional height when used, and then retracted and closed for storage when not in use.

While extension ladders provide for versatile use, the ladders can be difficult to maneuver to the location of desired use due to their relatively heavy weight and long length. Movement of the ladder often requires two people or a difficult and awkward process by one person.

Additionally, because of the extended length of the ladders in use, it is often necessary to have a second person stand at the base of the ladder and support or "foot" the ladder for the safety of the person climbing and working on the ladder.

SUMMARY OF THE INVENTION

In at least one aspect, the present invention provides a ladder support assembly including a base frame having first and second ends and a pair of pivot supports extending from the base frame which support a rod configured to pivotally support a ladder relative to the base frame. A pivot frame is pivotally mounted to the base frame and is biased away from the base frame. A bracket assembly is pivotally mounted to the pivot frame and includes a pair of bracket plates. Each bracket plate has an inner flange and outer flange with a ladder rail receiving area between the inner and outer flanges. The ladder receiving area is configured such that the bracket plate is slidable relative to a respective ladder rail received therein. A crank assembly includes a spool rotatably supported on the base frame and a cord wound about the spool with a free end of the cord connected to the bracket assembly. Rotation of the spool in a first direction takes up the cord and causes the pivot frame to pivot toward the base frame, thereby raising the ladder toward a raised position. Rotation of the spool in a second, opposite direction causes the cord to be let out and the pivot frame to pivot away from the base frame, thereby lowering the ladder toward a lowered transport position.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
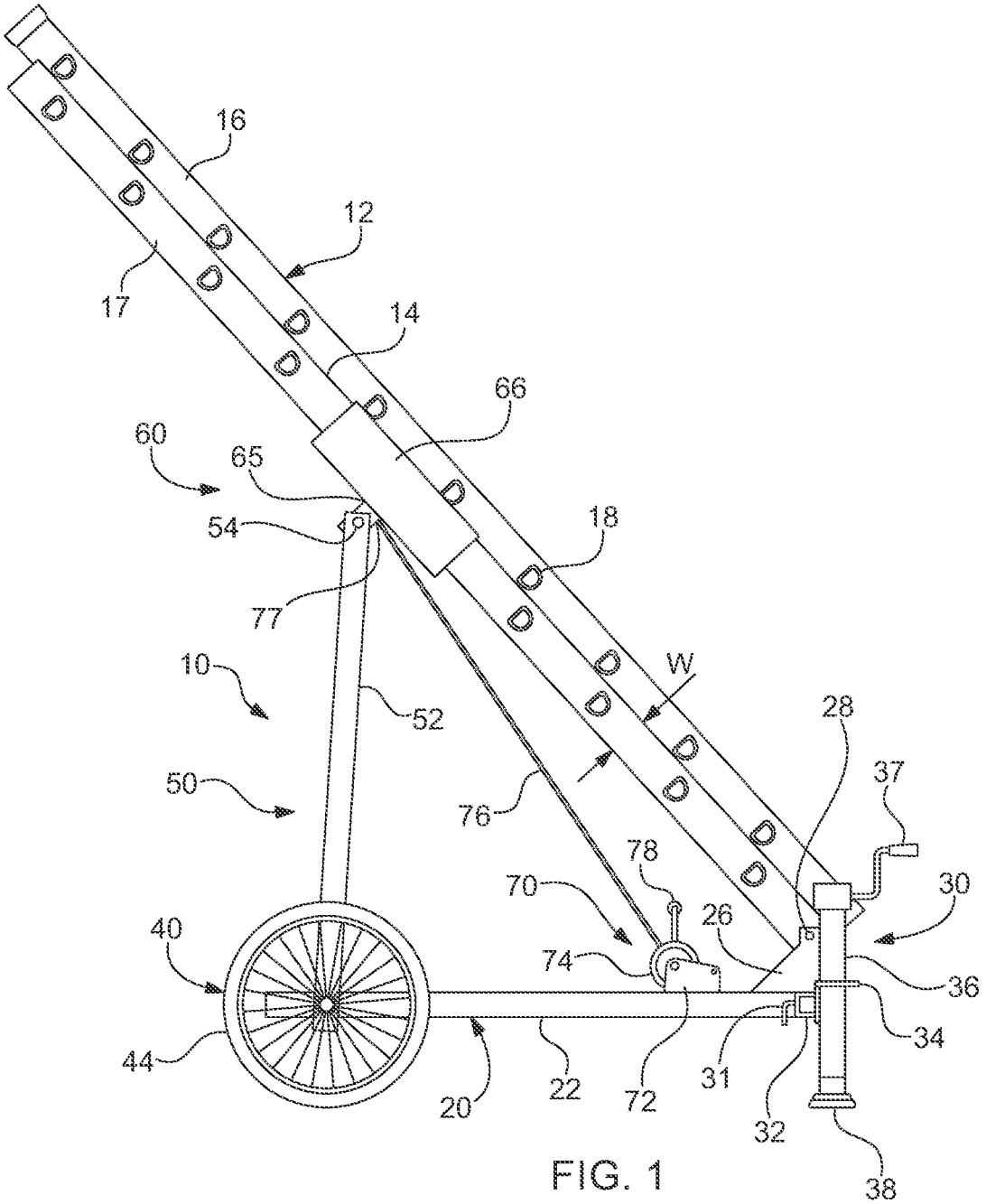
FIG. 1 is a side elevation view of a support assembly in accordance with an embodiment of the invention supporting an extension ladder in a transport position.
Figure 2:
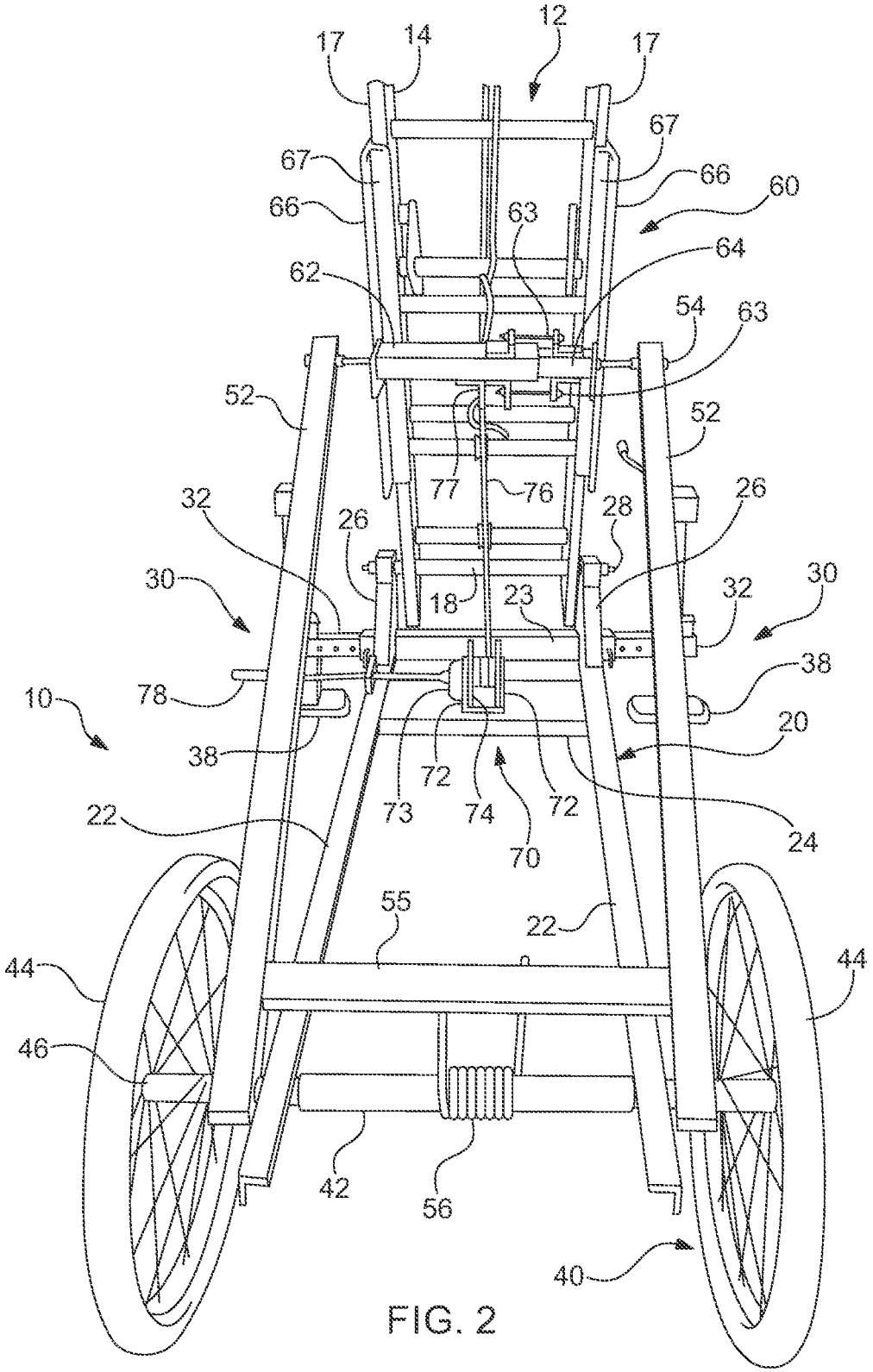
FIG. 2 is a front perspective view of the support assembly of FIG. 1.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 3:
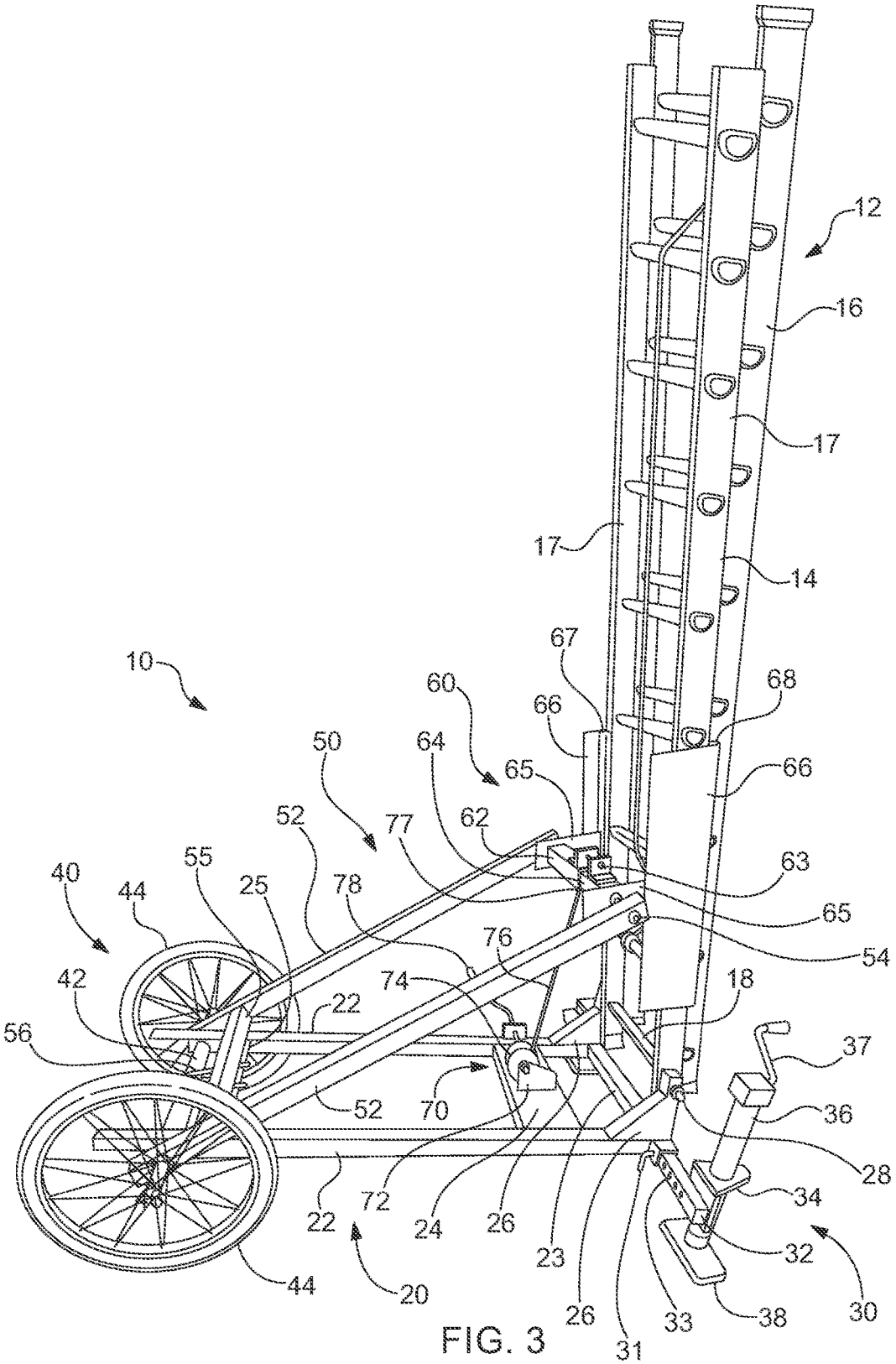
FIG. 3 is a side perspective view of the support assembly of FIG. 1 with the ladder in a raised position.

Referring to FIGS. 1-4, an exemplary ladder support assembly 10 in accordance with an embodiment of the invention will be described. The support assembly 10 generally includes a base frame 20 supported at one end by a pair of outrigger assemblies 30 and at the opposite end a wheel assembly, a pivot frame 50 pivotally supported relative to the base frame 20 with a ladder bracket assembly 60 on the free end thereof, and a crank assembly 70 which controls the angular relation of the pivot frame 50 and the base frame 20 to move the ladder 12 between a transport position (FIG. 1) and a fully raised position (FIG. 3). Each of the components will be described in more detail hereinafter.

The support assembly 10 is illustrated supporting an extension ladder 12. The illustrated extension ladder 12 includes a lower section 14 and an upper section 16 which are slidably mounted with respect to each other. Each section 14, 16 includes a pair generally parallel rails 17 with the usual rungs 18 for stepping on extending between the rails 17, with at least the bottom rung 18 of the lower section 14 having a passage therethrough. While an extension ladder with two sections is illustrated, the support assembly 10 is usable with ladders having only one section or more than two sections.

The illustrated base frame 20 includes a pair of side rails 22 extending between a pair of cross braces 23, 25 at opposed ends thereof. The cross brace 23 has a tubular configuration such that it can telescopingly receive a corresponding extension tube 32 of a respective outrigger assembly 30. Each extension tube 32 preferably has a plurality of pin receiving holes 33 configured to receive a pin 31 extending through the cross brace 23 such that each outrigger assembly 30 may be adjusted inwardly and outwardly relative to the base frame 20. Each outrigger assembly 30 further comprises an adjustment tube 36 connected to the extension tube 32 via a bracket 34. A support plate 38 is connected to one end adjustment tube 36 such that the vertical position of the support plate 38 relative to the bracket 34 may be adjusted. In the illustrated embodiment, the adjustment tube 36 includes an internal screw controlled by the handle 37 to lower and raise the position of the support plate 38. Other assemblies, for example, pneumatic or hydraulic cylinders, telescoping tubes with pin connections and the like, may be used for the adjustment tube 36. The horizontal and vertical adjustability of the outrigger assemblies 30 allow each support plate 38 to be positioned to provide a stable support for the base frame 20 even on uneven terrain. It is recognized that other aspects of the invention described herein may be carried out with supports for the base frame which provide less or no adjustability and the invention is not limited to the described outrigger assemblies.

A pivot support 26 extends upward from each side rail 22. The pivot supports 26 pivotally support a ladder rod 28 which extends through the open passage of the bottom rung 18 of the lower ladder section 14. The ladder 12 is thereby pivotally mounted with respect to the base frame 20.

The opposite end of the base frame 20 is supported by the wheel assembly 40. The wheel assembly 40 includes an axle 46 which extends through each of the side rails 22 and has a wheel 44 mounted on each end thereof. The wheels 44 are sized such that the base frame 20 is spaced off the ground surface and also has sufficient clearance to pivot about the axle 46 (see FIG. 5) without the forward end of the base frame 20 hitting the ground surface. A sleeve 42 extends over a central portion of the axle 46 and supports a spring 56 the function of which will be described hereinafter.

The pivot frame 50 includes a pair of side rails 52, with each side rail 52 pivotally mounted relative to a respective side rail 22 of the base frame 20. In the illustrated embodiment, the axle 46 extends through each pivot frame side rail 52 to provide such pivotal mounting. A cross brace 55 extends between the two side rails 52 proximate the pivotally mounted end. The spring 56 extends between the base frame cross brace 25 and the pivot frame cross brace 55 such that the pivot frame 50 is biased to pivot away from the base frame 20. At the opposite ends of the side rails 52, a pivot rod 54 extends between the rails 52 and pivotally supports a portion of the ladder bracket assembly 60.

The ladder bracket assembly 60 includes a pair of bracket plates 66. Each bracket plate 66 includes an inner flange 67 and an outer flange 68 with a ladder rail receiving area between the inner and outer flanges 67, 68. The ladder receiving area has a width slightly greater than the width W of the ladder rail 17 such that each rail 17 is securely retained, but the bracket plate 66 is slidable relative to the rail. The flanges 67 and 68 are illustrated as fixed, however, one or both flanges 67, 68 may be adjustably mounted on the plate 66 to accommodate rails 17 of different widths.

Each plate 66 has a mounting extension 65 extending therefrom, with each mounting extension 65 connected to a respective cross brace tube 62, 64. The pivot rod 54 extends through the cross brace tubes 62, 64 such that the ladder bracket assembly 60 is pivotally mounted with respect to the pivot frame 50. The cross brace tube 64 is telescopingly received in the cross brace tube 62 such that the tubes 62, 64, and thereby the bracket plates 66, are adjustable toward and away from each other. Such movement allows the bracket plates 66 to be moved apart to position the ladder 12 therebetween and then moved together to secure the rails 17 between the respective flanges 67, 68. Such movement also accommodates ladders of differing widths. Locking bolts 63 or the like extend between the cross brace tubes 62, 64 to lock the tubes 62, 64 relative to one another one the ladder 12 is positioned between the flanges 67, 68.

With the lower portion of the ladder 12 pivotally connected to the base frame 20 by ladder rod 28 and the ladder rails 17 positioned within but slidable relative to the bracket plates 66, a change in the angular relationship between the pivot frame 50 and the base frame 20 causes a corresponding in the angular orientation of the ladder 12 with respect to the base frame 20. The crank assembly 70 extends between the base frame 20 and the ladder bracket 60 to control such angular adjustment.

Figure 4:
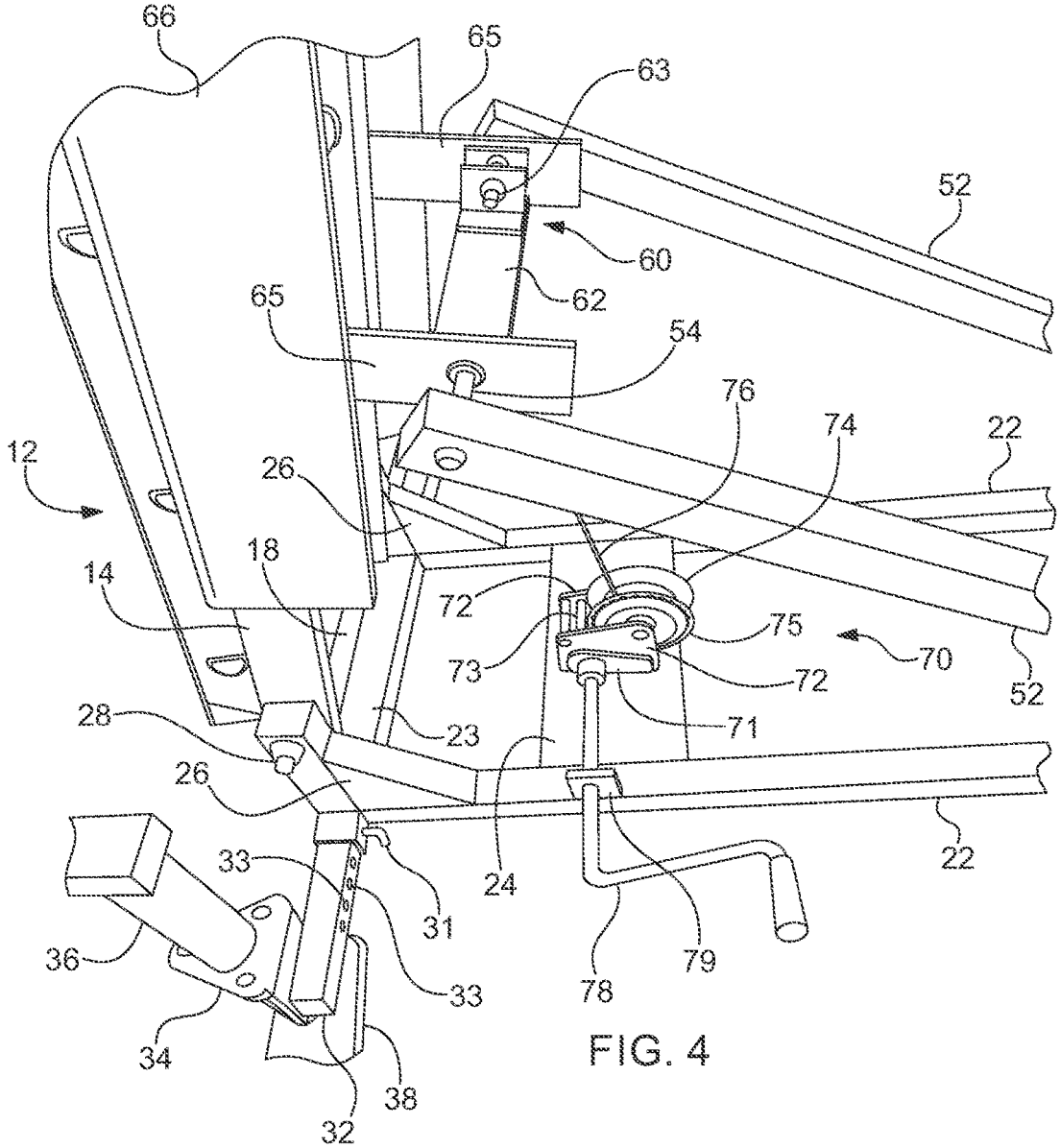
FIG. 4 is an expanded perspective view of a portion of the support assembly of FIG. 1.

With particular reference to FIG. 4, the crank assembly 70 includes a spool 74 rotatably supported between a pair of plates 72 which extend from a base plate 24 of the base frame 20. A cord 76 is wound about the spool 74 and has a free end 77 which connects to the cross brace tube 62. The spool 74 has a series of annual teeth 75 on one side thereof. A drive rod 73 extends between the plates 72 and engages the teeth 75, with an end of the drive rod 73 extending into a gear box 71 which in turn is connected to a handle 78. The handle 78 is supported by a bracket 79 extending from one of the base frame rails 22. The drive rod 73 is configured such that under no rotative load conditions, the drive rod 73 engages the teeth 75 and prevents the spool 74 from rotating. Application of a rotative load to the drive rod 73 via the handle 78 causes the drive rod 73 to rotate and thereby advance the teeth 75 and correspondingly rotate the spool 74 to either take in cord 76 or let out cord 76. To position the ladder 12 in the transport position illustrated in FIG. 1, the cord 76 is let out and the bias of the spring 56 and the weight of the ladder 12, pivots the pivot frame 50 away from the base frame 20 and the ladder 12 is moved by the sliding bracket plates 66. To raise the ladder, for example to the fully raised position in FIG. 3, the handle 78 is rotated in the opposite direction to pull in the cord 76 which causes the pivot frame 50 to pivot toward the base frame 20, and the ladder 12 is moved by the sliding bracket plates 66.

Figure 5:
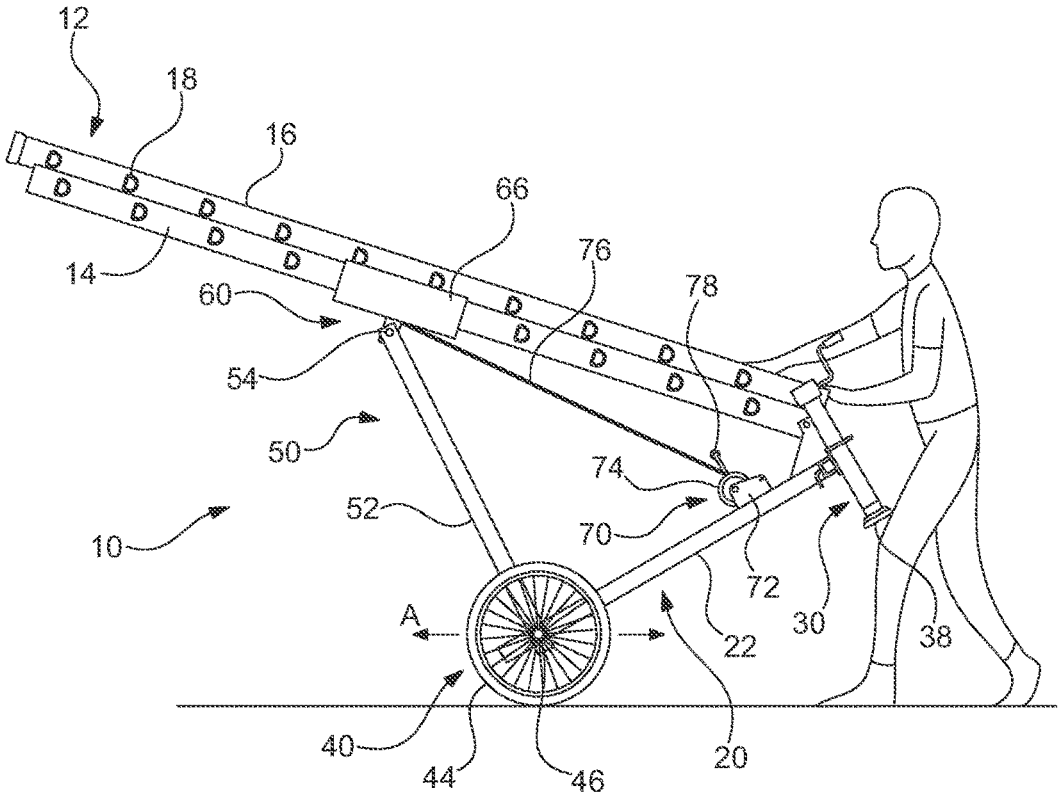
FIG. 5 is a side elevation view similar to FIG. 1 illustrating a ladder being transported.

Having described the components of the exemplary support assembly 10, various operations thereof will be described with reference to FIGS. 5-10. Referring to FIG. 5, when the ladder 12 is lowered to the transport position, a user can easily move the ladder 12 by raising the lower portion of the ladder 12 which in turn pivots the base frame 20 and pivot frame 50 about the axle 46, with the base and pivot frames 20, 50 maintaining their angular orientation to one another. With the ladder 12 so raised, the center of gravity is approximately over the wheel assembly 40 and a single user can easily wheel the assembly 10 and ladder 12 either forward or backward as indicated by arrow A.

Figure 6:
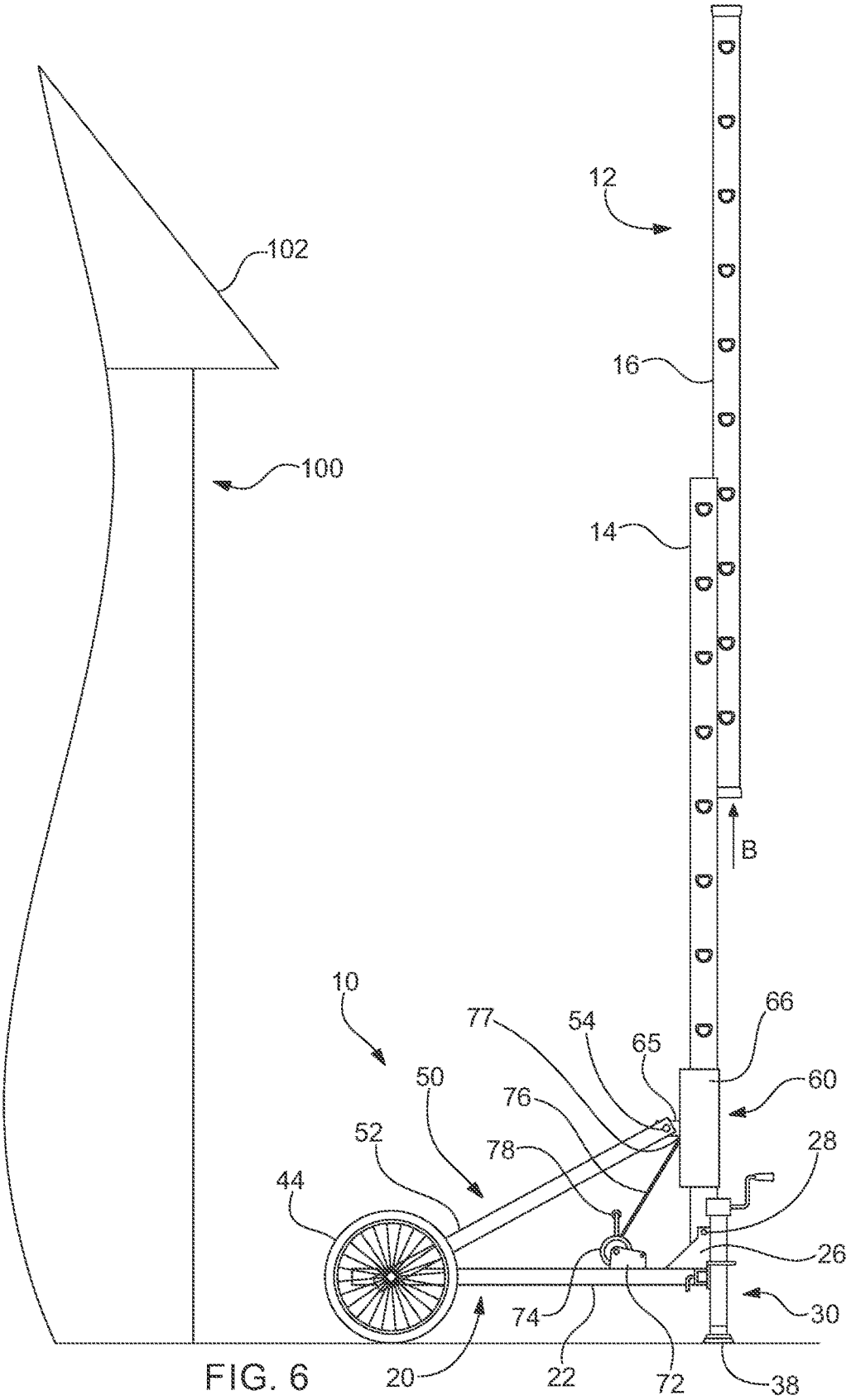
FIG. 6 is a side elevation view illustrating the support assembly positioned adjacent an exemplary building, with the ladder in a raised and extended position.
Figure 7:
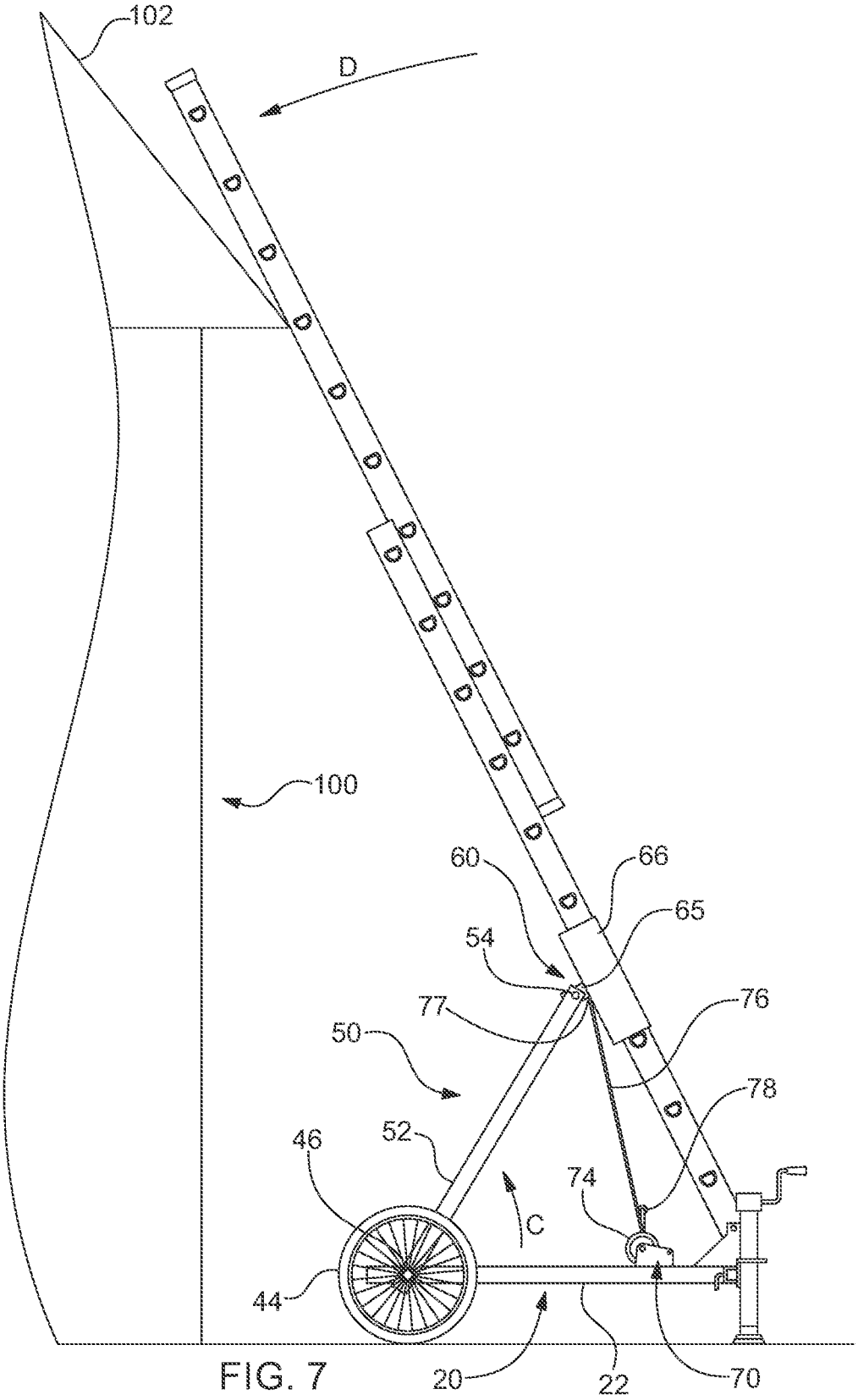
FIG. 7 is a side elevation view similar to FIG. 6 with the ladder lowered against the building.

Turning to FIGS. 3 and 6, once the support assembly 10 and ladder 12 are in a desired location, for example, proximate a building, the support assembly 10 may be stabilized utilizing the outrigger assemblies 30. Once stabilized, the crank assembly handle 78 may be rotated to pivot the ladder 12 toward the raised position illustrated in FIG. 3. After the ladder 12 is in the raised position, the upper section 16 may be extended relative to the lower section 14 in a standard manner as indicated by arrow B in FIG. 6. With the ladder extended to a desired height, the crank assembly handle 78 may be rotated in the opposite direction to lower the ladder 12 toward, for example, the roof 102 of the building 100 in a controlled manner as indicated by arrow D in FIG. 7. Such controlled lowering is beneficial in that it prevents banging of the ladder 12 against the building, the roof, gutters or the like. The user may then climb the ladder 12 without the need for a second person to foot the ladder as the support assembly 10 holds the ladder 12 in a stabile position. Once use of the ladder is complete, the ladder 12 may be easily raised away from the building via the crank assembly handle 78 and the user can retract the upper section 16 without having to worry about balancing the ladder 12. Once the upper section 16 is retracted, the ladder 12 may be pivoted to the transport position and the support assembly 10 and ladder 12 wheeled to a storage location or to a truck or the like for further transport.

Figure 8:
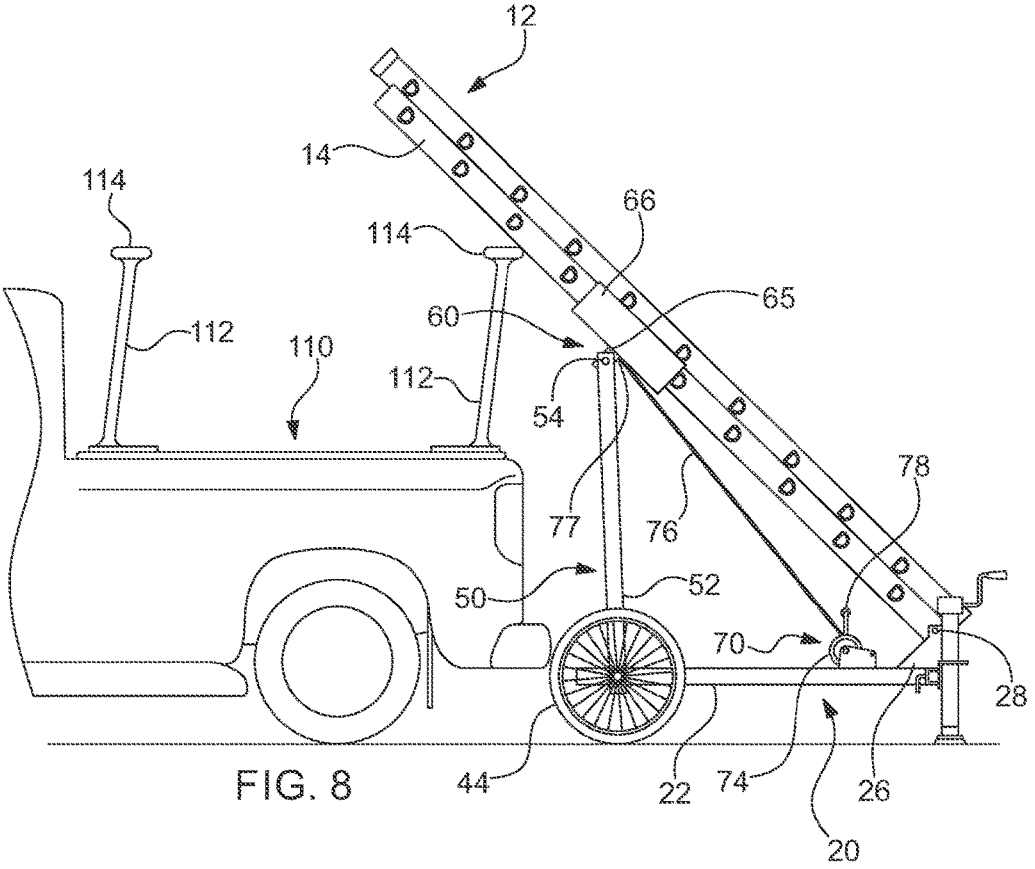
FIGS. 8-10 illustrate an exemplary process of positioning the ladder on a truck using the support assembly.
Figure 9:
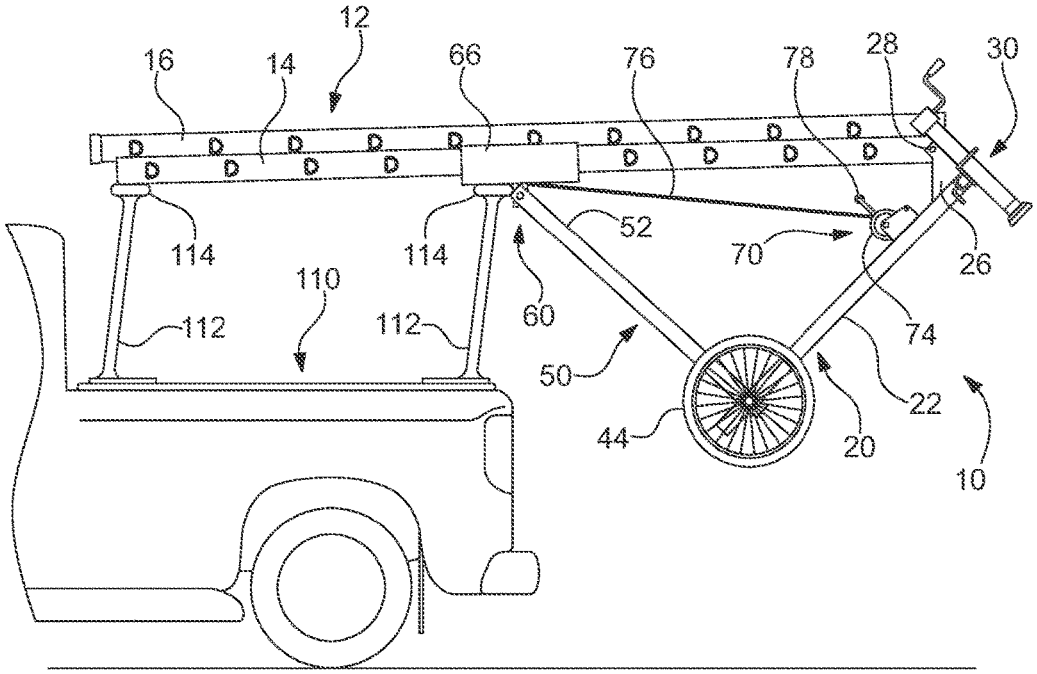
Figure 10:
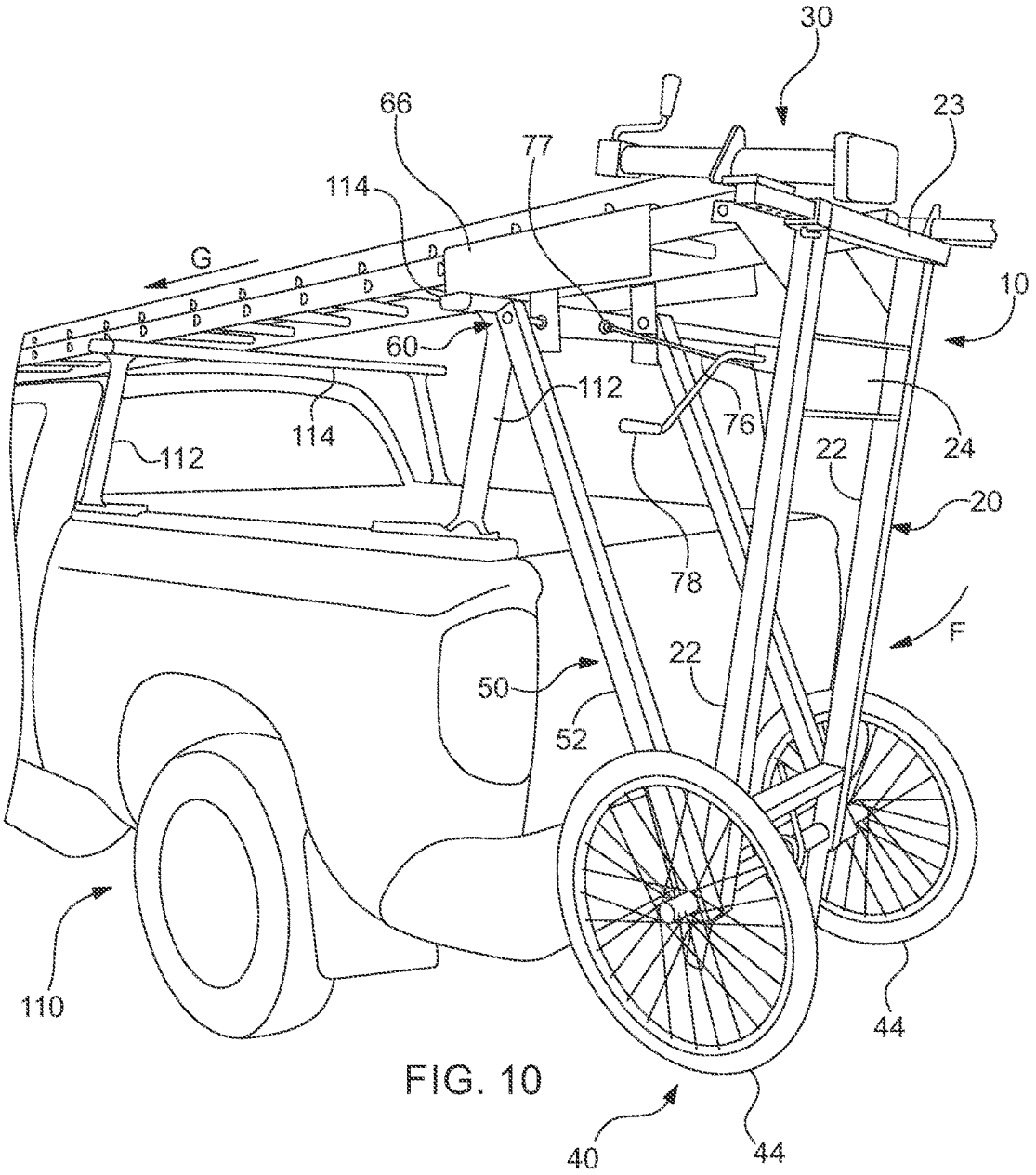

Referring to FIGS. 8-10, positioning of the ladder 12 and the support assembly 10 onto the rails 114 of a rack system 112 of a truck 110 will be described. With the ladder 12 in the transport position, the support assembly 10 is wheeled to the back of the truck 110 until the ladder 12 rests on the rear rail 114 as illustrated in FIG. 8. Turning to FIG. 9, the user lifts and rotates the support assembly 10, as indicated by arrow E, with the weight of the ladder 12 pulling the ladder 12 onto the rails 114. The crank assembly handle 78 is then rotated to move the base frame 20 toward the pivot frame 50, as indicated by arrow F in FIG. 10, such that the wheels 44 are adjacent the back of the truck 110 and the ladder 12 is extended further onto the rack 112, as indicated by arrow G.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A ladder support assembly comprising:

a base frame having first and second ends, a pair of side rails extending between the first and second ends, and at least one base frame cross brace extending between the pair of side rails;

a pair of pivot supports extending from the base frame proximate the first end;

a rod directly coupled to each of the pivot supports and spanning between the pivot supports, the rod configured to pivotally support a ladder relative to the base frame;

a pivot frame having first and second ends, a pair of side rails extending between the first and second ends of the pivot frame, and a pivot frame cross brace extending between the pair of side rails of the pivot frame, the pivot frame first end pivotally mounted adjacent the base frame second end, wherein the pivot frame is biased away from the base frame by a spring, wherein the spring extends between the at least one base frame cross brace and the pivot frame cross brace;

a bracket assembly pivotally mounted to the pivot frame second end, the bracket assembly including a pair of bracket plates, with each bracket plate having an inner flange and outer flange with a ladder rail receiving area between the inner and outer flanges, the ladder receiving area configured such that the bracket plates are slidable relative to a respective ladder rail received therein; and a crank assembly including a spool rotatably supported on the base frame and a cord wound about the spool with a free end of the cord connected relative to the pivot frame, whereby rotation of the spool in a first direction takes up the cord onto the spool and causes the pivot frame to pivot toward the base frame and rotation of the spool in a second direction opposite the first direction causes the cord to be let out from the spool and the pivot frame to pivot away from the base frame.

2. The ladder support assembly according to claim 1 wherein the first end of the base frame is supported by a pair of outrigger assemblies.

3. The ladder support assembly according to claim 2 wherein each outrigger assembly is laterally adjustable relative to the base frame.

4. The ladder support assembly according to claim 2 wherein each outrigger assembly includes an adjustment tube.

5. The ladder support assembly according to claim 4 wherein the adjustment tube includes an internal screw, a pneumatic cylinder, a hydraulic cylinder, or telescoping tubes with a pin connection.

6. The ladder support assembly according to claim 1 wherein the second end of the base frame is supported by a wheel assembly.

7. The ladder support assembly according to claim 6 wherein the wheel assembly includes a pair of wheels supported by an axle supported relative to the base frame.

8. The ladder support assembly according to claim 7 wherein each wheel has a height such that when the base frame is pivoted about the axle, the base frame remains clear of a surface upon which the wheels are positioned.

9. The ladder support assembly according to claim 7 wherein the axle pivotally supports the pivot frame relative to the base frame.

10. The ladder support assembly according to claim 1 wherein the bracket plates are laterally adjustable relative to one another.

11. The ladder support assembly according to claim 1 wherein the inner and outer flanges of each bracket assembly are moveable relative to one another such that the ladder rail receiving area is adjustable.

12. The ladder support assembly according to claim 1 wherein at least a portion of the spool includes teeth engaged by a drive portion of a handle and rotation of the handle causes rotation of the spool in either the first or second direction.

13. The ladder support assembly according to claim 1 wherein the free end of the cord is connected to the bracket assembly.

14. The ladder support assembly according to claim 1 wherein the free end of the cord is connected to the pivot frame.

15. An adjustable ladder system including:

a ladder comprising a pair of side rails with a plurality of rungs extending between the side rails, with at least a bottom rung defining a through passage; and a ladder support assembly comprising:

a base frame having first and second ends, a pair of side rails extending between the first and second ends, and at least one base frame cross brace extending between the pair of side rails, a pair of pivot supports extending from the base frame proximate the first end;

a rod directly coupled to each of the pivot supports and spanning between the pivot supports, the rod extending through the bottom rung through passage;

a pivot frame having first and second ends, a pair of side rails extending between the first and second ends of the pivot frame, and a pivot frame cross brace extending between the pair of side rails of the pivot frame, the pivot frame first end pivotally mounted adjacent the base frame second end, wherein the pivot frame is biased away from the base frame by a spring, wherein the spring extends between the at least one base frame cross brace and the pivot frame cross brace;

a bracket assembly pivotally mounted to the pivot frame second end, the bracket assembly including a pair of bracket plates, with each bracket plate having an inner flange and outer flange with a ladder rail receiving area between the inner and outer flanges, each ladder rail received in a respective ladder receiving area such that the bracket plates are slidable relative to the respective ladder rail received therein; and a crank assembly including a spool rotatably supported on the base frame and a cord wound about the spool with a free end of the cord connected relative to the pivot frame, whereby rotation of the spool in a first direction takes up the cord onto the spool and causes the pivot frame to pivot toward the base frame, thereby raising the ladder toward a raised position, and rotation of the spool in a second direction opposite the first direction causes the cord to be let out from the spool and the pivot frame to pivot away from the base frame, thereby lowering the ladder toward a lowered transport position.

16. The system according to claim 15 wherein the ladder is an extension ladder.

17. The ladder support assembly according to claim 7, further comprising a sleeve extending over a central portion of the axle, wherein the sleeve is configured to support the spring.

* * * * *